US012687164B2

(12) United States Patent
Evans et al.

(10) Patent No.: US 12,687,164 B2
(45) Date of Patent: Jul. 21, 2026

(54) PUMP FLUID END WITH TOROIDAL SURFACE AT INTERSECTION OF PLUNGER BORE AND CROSS BORE

(71) Applicant: NATIONAL OILWELL VARCO, L.P., Houston, TX (US)

(72) Inventors: James Sterling Evans, Owasso, OK (US); Kyle Christopher Chady, Broken Arrow, OK (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 0 days.

(21) Appl. No.: 18/604,932

(22) Filed: Mar. 14, 2024

(65) Prior Publication Data

US 2025/0290506 A1 Sep. 18, 2025

(51) Int. Cl.
*F04B 53/16* (2006.01)

(52) U.S. Cl.
CPC ..... *F04B 53/16* (2013.01)

(58) Field of Classification Search
CPC ..... F04B 53/16; F04B 27/0891
See application file for complete search history.

(56) References Cited

U.S. PATENT DOCUMENTS

| | | | | |
|---|---|---|---|---|
| 6,623,259 | B1 | 9/2003 | Blume | |
| 7,186,097 | B1 | 3/2007 | Blume | |
| 7,484,452 | B2 | 2/2009 | Baxter et al. | |
| 7,513,759 | B1 | 4/2009 | Blume | |
| 8,784,081 | B1 * | 7/2014 | Blume | F04B 53/22 417/559 |
| 9,127,631 | B2 | 9/2015 | Petrone et al. | |
| 9,188,121 | B1 | 11/2015 | Dille | |
| 9,297,375 | B1 * | 3/2016 | Dille | F04B 53/16 |
| 9,383,015 | B2 | 7/2016 | Cary | |
| 9,945,362 | B2 | 4/2018 | Skurdalsvold et al. | |
| 9,989,053 | B2 | 6/2018 | Ladd et al. | |
| 10,221,847 | B2 | 3/2019 | Dyer | |
| 10,337,508 | B2 | 7/2019 | Cary et al. | |
| 10,731,643 | B2 * | 8/2020 | DeLeon, II | F04B 53/1032 |
| 10,794,381 | B2 | 10/2020 | Dyer et al. | |

(Continued)

FOREIGN PATENT DOCUMENTS

| | | |
|---|---|---|
| CN | 203023039 | 6/2013 |
| CN | 203548184 U | 4/2014 |

(Continued)

OTHER PUBLICATIONS

English Machine Translation of WO2024145885A1 (Year: 2024).*

(Continued)

*Primary Examiner* — Nathan C Zollinger
(74) *Attorney, Agent, or Firm* — Schwegman Lundberg & Woessner, P.A.

(57) ABSTRACT

A positive displacement pump system can include a fluid end block, which can be configured to provide a pumping chamber and control a flow of a fluid through the positive displacement pump system. The fluid end block can include a first cylindrical wall defining a plunger bore extending partially through the fluid end block and a second cylindrical wall defining a fluid conveying cross bore that intersects the plunger bore defining a bore intersection rim. A portion of the first bore intersection rim can include a first toroidal surface.

23 Claims, 14 Drawing Sheets

(56) References Cited

U.S. PATENT DOCUMENTS

| | | | | |
|---|---|---|---|---|
| 11,181,108 | B2 | 11/2021 | Brooks et al. | |
| 11,225,861 | B1 | 1/2022 | Dille et al. | |
| 11,401,930 | B2 * | 8/2022 | Skurdalsvold | B23P 15/00 |
| 2012/0288387 | A1 | 11/2012 | Freed et al. | |
| 2014/0083541 | A1 | 3/2014 | Chandrasekaran et al. | |
| 2014/0345452 | A1 | 11/2014 | Cary | |
| 2019/0011051 | A1 | 1/2019 | Yeung | |
| 2019/0301447 | A1 * | 10/2019 | Skurdalsvold | F04B 1/00 |
| 2020/0355182 | A1 * | 11/2020 | DeLeon, II | F04B 15/04 |
| 2023/0407854 | A1 | 12/2023 | Chady et al. | |
| 2023/0407856 | A1 | 12/2023 | Bolt et al. | |

FOREIGN PATENT DOCUMENTS

| | | | | |
|---|---|---|---|---|
| CN | 203756506 | | 8/2014 | |
| DE | 102009001463 | | 9/2010 | |
| WO | WO-2015179839 | A1 * | 11/2015 | F04B 19/22 |
| WO | WO-2024145885 | A1 * | 7/2024 | |
| WO | WO-2025193373 | A1 | 9/2025 | |

OTHER PUBLICATIONS

"International Application Serial No. PCT/US2025/015341, International Search Report mailed Apr. 7, 2025", 4 pgs.
"International Application Serial No. PCT/US2025/015341, Written Opinion mailed Apr. 7, 2025", 7 pgs.
"Products", Strom Flow Makes Energy, [Online]. Retrieved from the Internet https web.archive.org web 20140628235529 , 4 pgs.
"McFarland—TriTan, LLC", Series 3140 SX Triplex Plunger Pumps, 2 pgs.

* cited by examiner

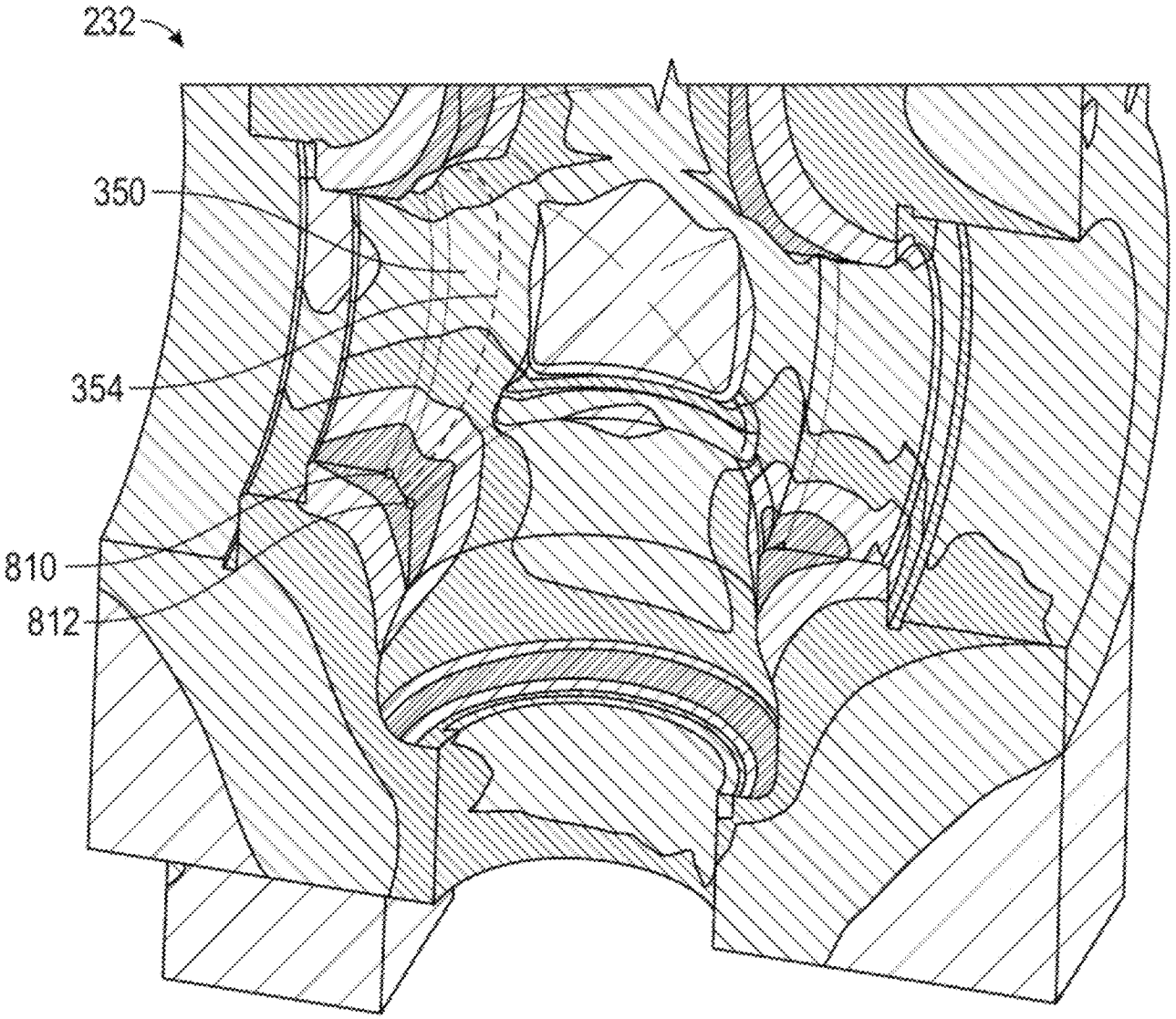
FIG. 8
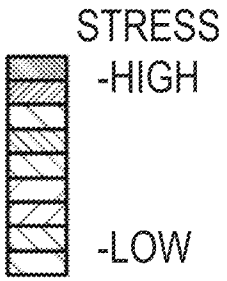

PUMP FLUID END WITH TOROIDAL SURFACE AT INTERSECTION OF PLUNGER BORE AND CROSS BORE

TECHNICAL FIELD

The present disclosure relates to pumps. More particularly, the present disclosure relates to a fluid end of positive displacement pumps. Still, more particularly, the present disclosure relates to the internal contours of the fluid end.

BACKGROUND

The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

Pumps can be used to move fluids, such as liquids, gasses, and slurries. A pump can include a pump assembly for moving the pumpable fluid, and an energy source for providing the pumping energy. The pump assembly can take on multiple forms including impulse pumps, velocity pumps, and positive displacement pumps.

In the case of positive displacement pumps, such as piston or plunger pumps, the energy source can provide a rotational force to drive a crankshaft that causes the pistons or plungers to move. Fluid communication with the pistons or plungers can be controlled by one or more valves. Positive displacement pumps may be desirable in high pressure or harsh conditions, because they may be more efficient than other style pumps at high pressures or less affected by harsh operating conditions than other style pumps.

SUMMARY

In an example, a positive displacement pump system can include a fluid end block, which can be configured to provide a pumping chamber and control a flow of a fluid through the positive displacement pump system. The fluid end block can include a first cylindrical wall defining a plunger bore extending partially through the fluid end block and a second cylindrical wall defining a fluid conveying cross bore that intersects the plunger bore defining a bore intersection rim. A portion of the first bore intersection rim can include a first toroidal surface.

In an example, a positive displacement pump system can include a fluid end block, which can be configured to provide a pumping chamber and control a flow of a fluid through the positive displacement pump system. The fluid end block can include a first cylindrical wall defining a plunger bore extending partially through the fluid end block and a second cylindrical wall defining a fluid conveying cross bore that intersects the plunger bore defining a bore intersection rim. A portion of the bore intersection rim can define a concave surface.

In an example, a method of manufacturing a fluid end block of a positive displacement pump system can include manufacturing a first cylindrical wall defining a plunger bore extending partially through the fluid end block, The method can also include manufacturing a second cylindrical wall defining a fluid conveying cross bore that intersects the plunger bore defining a bore intersection rim. The method can also include manufacturing a toroidal surface along a portion of the bore intersection rim.

BRIEF DESCRIPTION OF THE DRAWINGS

In the drawings, which may not be drawn to scale, like numerals may describe substantially similar components throughout one or more of the views. Like numerals having different letter suffixes may represent different instances of substantially similar components. The drawings illustrate generally, by way of example but not by way of limitation.

FIG. 8 shows a perspective view of a stress plot of an example of portions of the fluid end block of FIG. 3.

DETAILED DESCRIPTION

A fluid end block of a positive displacement pump system can experience large material stresses. For example, pressures within the fluid end block can induce a stress in the walls of the fluid end block. The stress may reach a relative maximum near a region where bores within the fluid end block intersect. For example, the stress may reach a maximum along the bore intersection rim of a plunger bore and a fluid conveying cross bore. This stress can cause a material failure, such as stress cracking. The present application, in one or more examples, relates to providing a toroidal surface along a portion of the bore intersection rim, which can help reduce material stress along a portion of the bore intersection rim.

Figure 1:
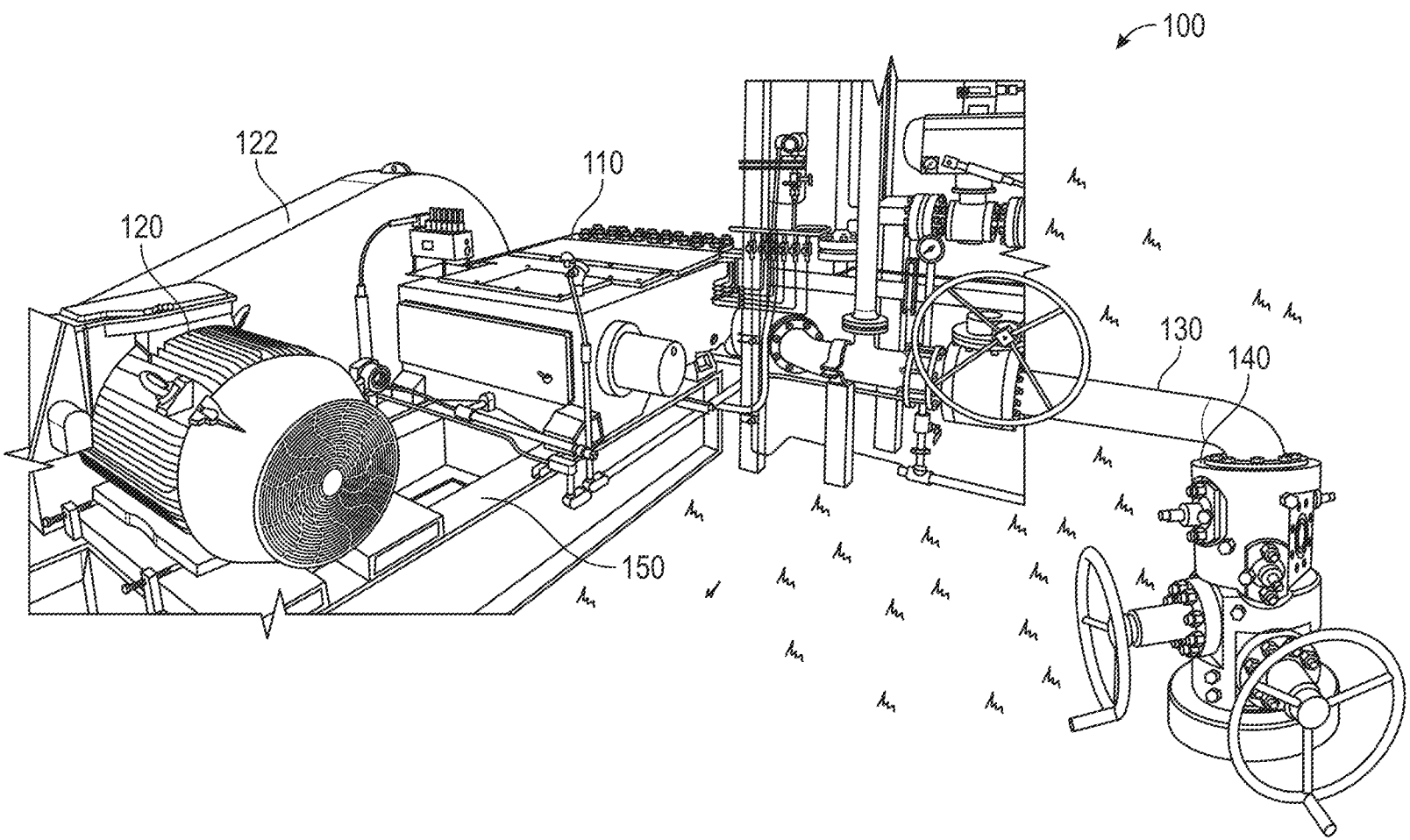
FIG. 1 shows an example of portions of a positive displacement pump system having a fluid end block, including portions of the environment in which the positive displacement pump system can be used.

FIG. 1 shows an example of portions of a positive displacement pump system 110 having a fluid end block, including portions of the environment 100 in which the positive displacement pump system 110 can be used. The positive displacement pump system 110 can be configured to generate pressurized fluid flow, which can be used to perform one or more operations, such as fracking. The positive displacement pump system 110 can use rotational mechanical power provided by the electric motor 120 to pressurize fluid from a low-pressure reservoir (e.g., a tank) and transport the pressurized fluid into a high-pressure reservoir (e.g., the well below the wellhead 140). In an example, another source of rotational mechanical power can be used, alternatively or in addition to the electric motor 120. For example, one or more of an internal combustion engine (e.g., diesel engine) or a turbine (e.g., diesel turbine, gas turbine) could be used, alternatively or in addition to the electric motor 120. The positive displacement pump system 110 can be coupled to the electric motor 120, which can allow the electric motor 120 to drive the positive displacement pump system 110. The positive displacement pump system 110 and the electric motor 120 can be mounted on a skid 150, such as may help with transport or installation.

The electric motor 120 may be configured to rotate a shaft when electrical power is applied to the electric motor 120. This force on the shaft can be used to drive the positive displacement pump system 110. The electric motor 120 can be connected to a power grid or other system capable of providing energy (e.g., a battery) by a variable frequency drive (VFD) or other electrical coupling device. The electric motor 120 may be mechanically coupled to the positive displacement pump system 110 by a coupling device 122. The electric motor 120 may include a stator and a rotor. The rotor may be coupled to or form the shaft of the electric motor 120. The electric motor 120 may include leads to provide the power from the energy source to the stator. A VFD may control the speed and/or power output of the electric motor 120. The electric motor 120 may include a permanent magnet synchronous motor, a squirrel cage induction motor, a generator with an excitable field coil, or the like.

The coupling device 122 may include a belt, chain, gears, shaft coupling, etc. The coupling device 122 may couple a shaft of the electric motor 120 to a crankshaft or other input of the positive displacement pump system 110. In an example, the electric motor 120 may be directly coupled to the shaft of the positive displacement pump system 110 (e.g., the rotary member 206) without requiring a coupling device 122.

The wellhead 140 may seal off the high-pressure reservoir, such as an underground well. The wellhead 140 may be coupled to the positive displacement pump system 110 by high-pressure piping 130. The high-pressure reservoir may vary in pressure, such as may include varying in pressure based upon the amount of fluid injected into the reservoir. In an example, the high-pressure reservoir may start at atmospheric pressure before fluid is injected, and may then attain a pressure of 5,000 psi, 10,000 psi, 15,000 psi, or 20,000 psi. In an example, the pressure of the high-pressure reservoir may be greater than or equal to 5000 psi. The high-pressure reservoir may receive a flow of a substantially incompressible fluid from the positive displacement pump system 110. The flow can include one or more of water or oil with or without entrained solids.

Figure 2:
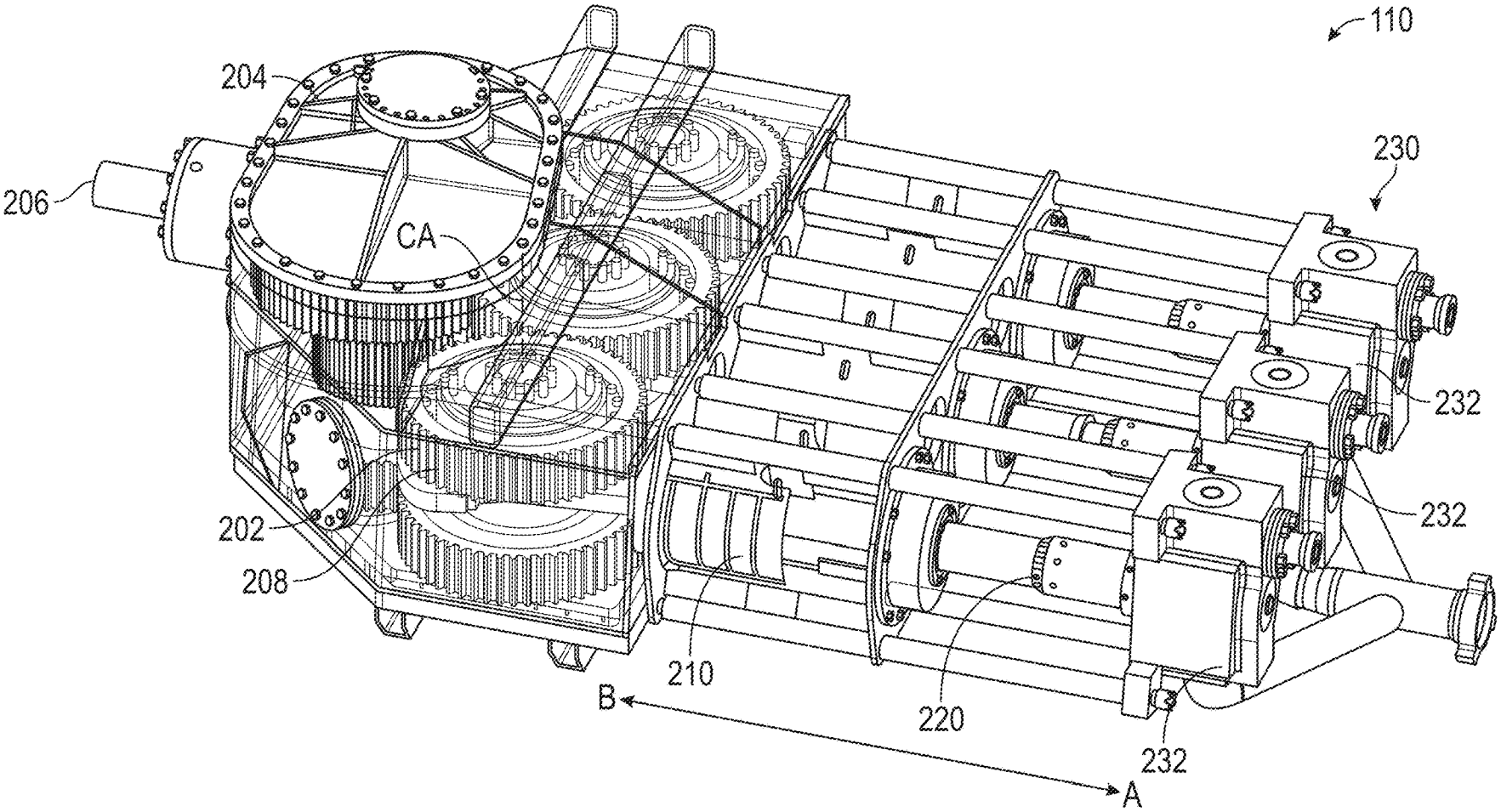
FIG. 2 shows a perspective view of an example of portions of a positive displacement pump system having a fluid end block.

FIG. 2 illustrates a perspective view of an example of a positive displacement pump system 110 having a fluid end block 232. The positive displacement pump system 110 of FIG. 2 can be configured similarly to the positive displacement pump system 110 of FIG. 1, or the pump system can differ in one or more ways. The positive displacement pump system 110 can be a reciprocating pump used to pump fluids across multiple industries (e.g., oil and gas, chemical processing, food and beverage, pharmaceuticals, water and wastewater treatment, mining, agriculture, construction, marine, pulp and paper, manufacturing, or the like). In examples, the positive displacement pump system 110 can include a crank member 202, a wrist pin assembly 210, a plunger assembly 220, and a fluid end 230. Examples of positive displacement pump systems are described in Bolt, et al. U.S. patent application Ser. No. 17/807,066 entitled "LONG STROKE PARALLEL PUMP" filed on Jun. 15, 2022 and Chady, et al. U.S. patent application Ser. No. 18/347,325 entitled "LONG STROKE PARALLEL PUMP" filed on Jul. 5, 2023, which are hereby incorporated by reference herein in their entirety.

The crank member 202 can be configured to translate a rotational motion from a rotary member 206 (e.g., motor shaft) to the wrist pin assembly 210. The crank member 202 can be installed within a crank member housing 204. A rotary member 206 can extend through the crank member housing 204 to couple the crank member 202 to a power source. The rotary member 206 can be a shaft coupled to the crank member 202, via a cam, or any other device that can transfer rotational motion from a shaft rotating about a first axis to a gear, disc, sprocket, or the like rotating about a second axis. In examples, the crank member 202 can be rotatable about a central axis CA such that the rotational energy of the rotary member 206 can rotate the crank member 202. For example, a perimeter surface 208 of the crank member 202 can be in direct contact with the rotary member 206 such that the rotary member 206 rotates the crank member 202 about the central axis CA. In other examples, as shown, intermediate gears speed reducing and/or increasing gears may be provided. The crank member 202 can include cast iron, carbon steel, alloy steel, forged steel, billet steel, nodular iron, any combination or alloy thereof, or the like.

The wrist pin assembly 210 can be configured to transfer axial load from the crank member 202 to the plunger assembly 220. The wrist pin assembly 210 can be pivotably coupled to the crank member 202 by way of a connecting rod or other rod, for example. The wrist pin assembly 210 can be operable to translate in a first direction A and a second direction B as the crank member 202 rotates. In an example, other structures configured to provide lateral movement of the plunger assembly can be used, alternatively or in addition to the structure shown in FIG. 2. In an example, a hydraulic cylinder can be used to push and pull the plunger assembly 220. In an example, a camshaft can be used to push the plunger assembly 220 and a spring can be used to provide a return force on the plunger assembly 220.

The plunger assembly 220 can be configured to receive the axial load from the wrist pin assembly 210 and translate in the first direction A and the second direction B into and out of the fluid end 230, respectively. The plunger assembly 220 can be directly coupled to the wrist pin assembly 210. The plunger assembly 220 can translate along a longitudinal axis in the first direction A and the second direction B as the crank member 202 rotates.

The fluid end 230 can be configured to use the energy provided by the plunger assembly 220 to pump the fluid through the positive displacement pump system 110. The fluid end 230 can be pressurized by the plunger assembly 220 moving in the first direction A and depressurized by the plunger assembly 220 moving in the second direction B. In an example, as the fluid end 230 is depressurized, the fluid end 230 can draw a working fluid within the fluid end 230 (e.g., from a fluid supply source), and as the fluid end 230 is pressurized, the fluid end 230 can expel the working fluid from the fluid end 230 (e.g., to a pressurized side such as to a wellhead for fracking or other operations) to move the working fluid through the fluid end 230. The fluid end 230 can include one or more fluid end blocks 232, such as can include one fluid end block 232, two fluid end blocks 232, three fluid end blocks 232 (as shown in FIG. 2), or four or more fluid end blocks 232.

The fluid end block 232 can be configured to provide a pumping chamber, such as a pumping chamber for the positive displacement pump system 110, control a flow of a fluid through the positive displacement pump system 110, or both. The fluid end block 232 can be configured to interface with the plunger assembly 220, such as can include receiving a portion of the plunger assembly 220 within the fluid end block 232. The pumping chamber can include a fluidly sealed chamber that is configured for containing one or more of positive pressures (e.g., pressures above atmospheric, such as a discharge pressure) or negative pressures (e.g., pressures below atmospheric, such as a suction pressure). The fluid end block 232 can include one or more valves to control the flow of fluid through the fluid end block 232. All of the fluid end blocks 232 can be configured similarly or one or more of the fluid end blocks 232 can be configured differently from one or more of the other fluid end blocks 232.

Figure 3:
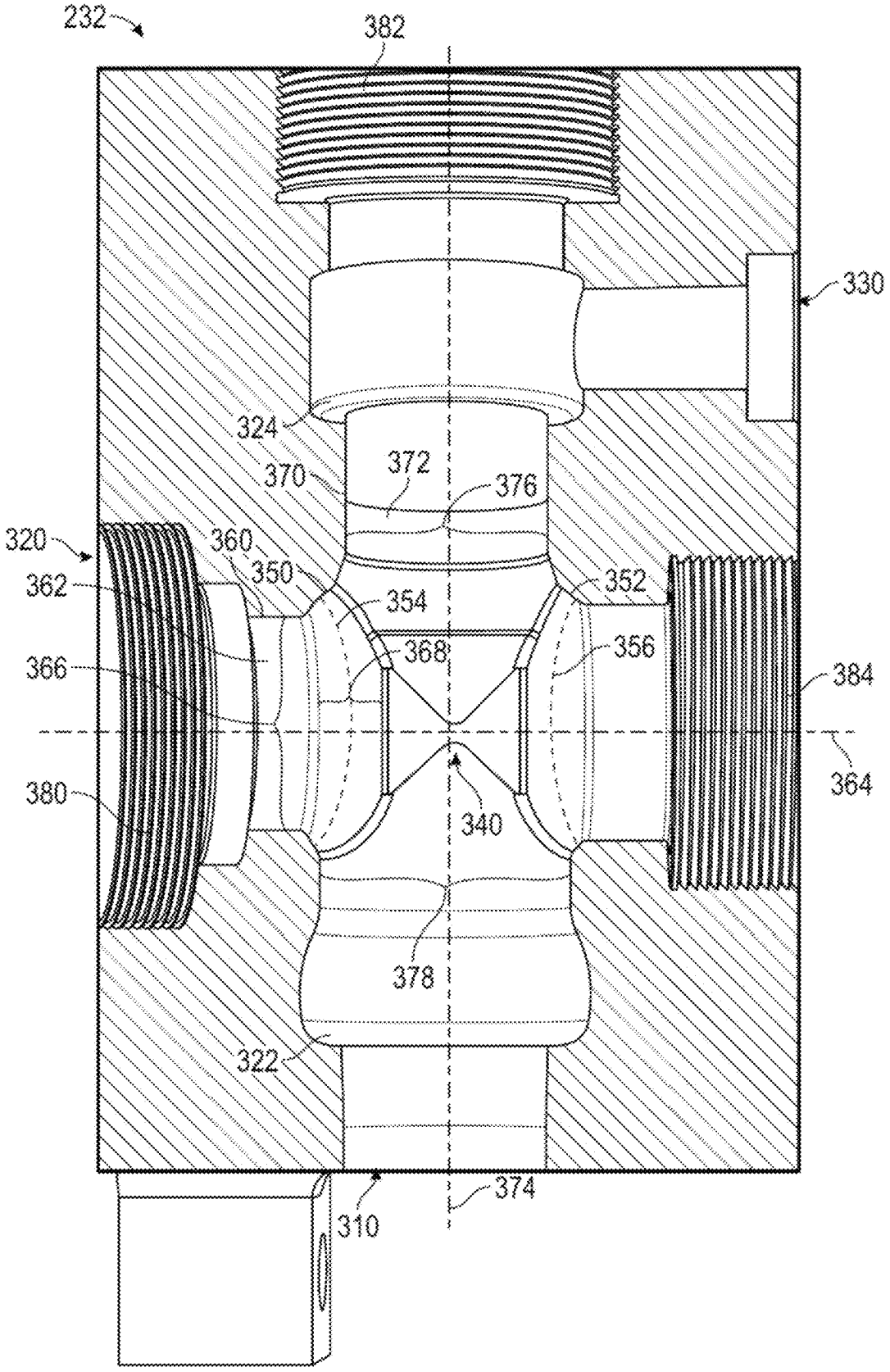
FIG. 3 shows a cross-sectional view of an example of portions of a fluid end block.

FIG. 3 shows a cross-sectional view of an example of portions of a fluid end block 232. The fluid end block 232 shown in FIG. 3 can be one of the fluid end blocks 232 of the example of FIG. 2. FIG. 3 shows that the fluid end block 232 can include an inlet port 310, an outlet port 330, and a plunger assembly interface port 320. The fluid end block 232 can also include a first cylindrical wall 360, which can define a plunger bore 362, and a second cylindrical wall 370, which can define a fluid conveying cross bore 372.

The plunger bore 362 can be configured to interface with the plunger assembly 220. For example, the plunger bore 362 can be configured to receive a plunger, such as during a portion of the pumping stroke, fluidly communicate with the plunger assembly 220, or both. The plunger bore 362 can define a portion of the pumping chamber 340. The plunger bore 362 can extend partially through the fluid end block 232, which can include extending only part way through (e.g., one-third of the way, two-thirds of the way, etc.) or extending all the way through the fluid end block 232. The plunger bore 362 can extend along a first center axis 364, which may align with the longitudinal axis of the plunger assembly. The plunger bore 362 can be circular in cross-section (e.g., the shape of the plunger bore 362 perpendicular to the first center axis 364), or can have any other two dimensional shape in cross-section (e.g., elliptical, square, freeform (e.g., not a named geometric shape), etc.). A cross-sectional shape and/or size of the plunger bore 362 can vary along a length of the first center axis 364. For example, the plunger bore 362 could have an elliptical cross-section of a specified size at one location, and a circular cross-section of a second specified size at another location. The plunger bore 362 can have a first diameter 366.

The fluid conveying cross bore 372 can be configured to convey fluid through the fluid end block 232, and can be configured to fluidly communicate with the plunger bore 362 (e.g., due to at least partially intersecting). The fluid conveying cross bore 372 can be configured to convey fluid from the inlet port 310 to the outlet port 330. The fluid conveying cross bore 372 can define a portion of the pumping chamber 340. The fluid conveying cross bore 372 can extend partially through the fluid end block 232, which can include extending only part way through (e.g., one-third of the way, two-thirds of the way, etc.) or extending all the way through the fluid end block 232. The fluid conveying cross bore 372 can extend along a second center axis 374. The fluid conveying cross bore 372 can be circular in cross-section (e.g., the shape of the fluid conveying cross bore 372 perpendicular to the second center axis 374), or can have any other two dimensional shape in cross-section (e.g., elliptical, square, freeform (e.g., not a named geometric shape), etc.). A cross-sectional shape and/or size of the fluid conveying cross bore 372 can vary along a length of the second center axis 374. For example, FIG. 3 shows that the fluid conveying cross bore 372 can have a second diameter 376 in one region and a third diameter 378 in another region. The cross-sectional shape and/or size of the fluid conveying cross bore 372 can be different from the plunger bore 362 in one or more regions, or can be the same as the plunger bore 362 in one or more regions. In an example, one or more of the second diameter 376 or the third diameter 378 can be different from the first diameter 366.

The fluid conveying cross bore 372 can intersect the plunger bore 362, which can include any portion of the second cylindrical wall 370 intersecting the first cylindrical wall 360. The intersection between the fluid conveying cross bore 372 and the plunger bore 362 can place the fluid conveying cross bore 372 and the plunger bore 362 in fluid communication (e.g., fluid can flow between the fluid conveying cross bore 372 and the plunger bore 362). The fluid conveying cross bore 372 and the plunger bore 362 can intersect along a first bore intersection rim 354. The first bore intersection rim 354 can be defined by the points of intersection between the second cylindrical wall 370 and the first cylindrical wall 360.

Figure 10:
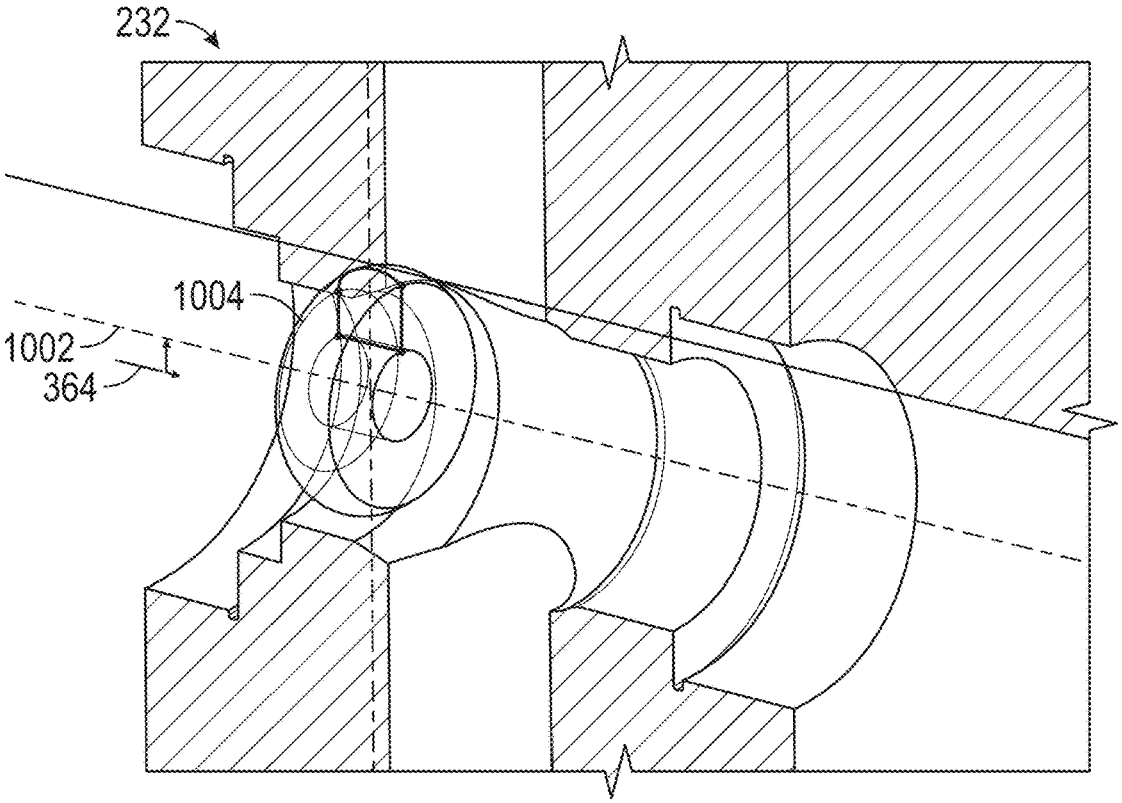
FIG. 10 shows a cross-sectional perspective view of an example of portions of a fluid end block and a first toroid.
Figure 11:
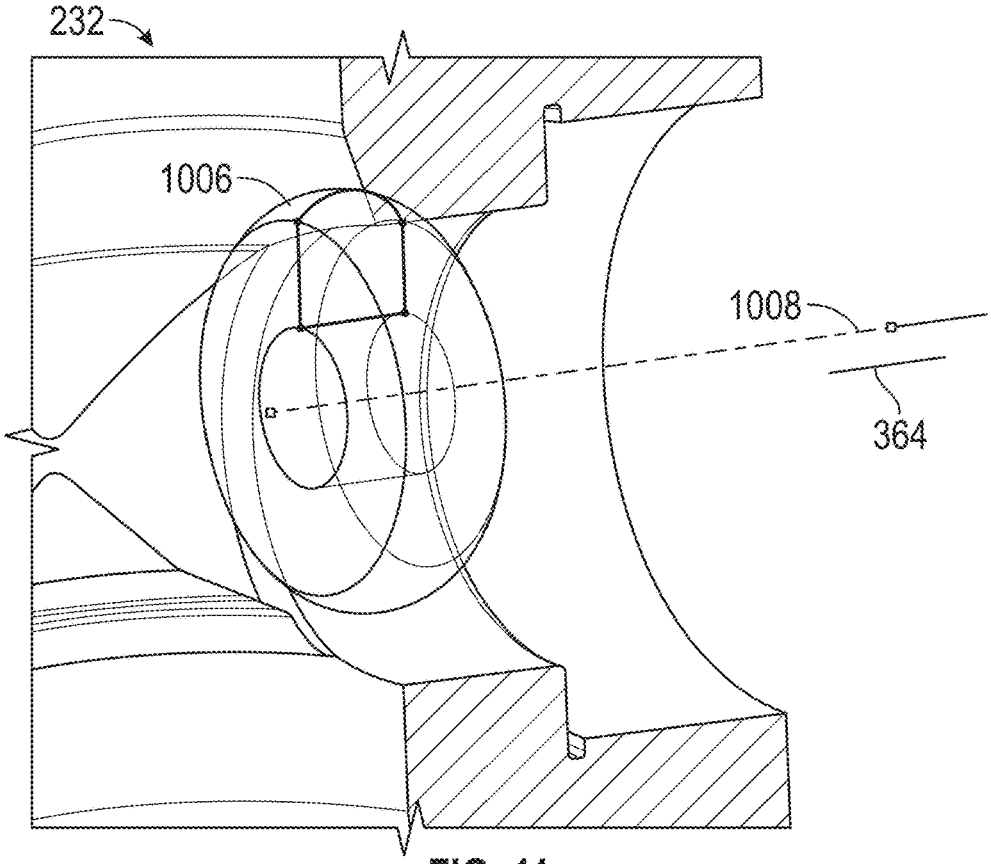
FIG. 11 shows a cross-sectional perspective view of an example of portions of the fluid end block of FIG. 10 and a second toroid.

A portion of the first bore intersection rim 354 can define a first toroidal surface 350. The first toroidal surface 350 can be configured to reduce a material stress in one or more portions of the first bore intersection rim 354, such as by spreading a stress out over a larger area. In an example, the first toroidal surface 350 can be present along a full length of the first bore intersection rim 354, which can include along the entire perimeter of the first cylindrical wall 360 and/or the second cylindrical wall 370. In an example, the first toroidal surface 350 may only be present along one or more portions of the first bore intersection rim 354, such as can include one or more specified rotational degree ranges (e.g., from 30 to 180 degrees, from 60 to 90 degrees, etc.). The first toroidal surface 350 can take the form of a two-dimensional shape (e.g., a circle, an ellipse, a square, a polygon, a freeform shape (e.g., not a named geometric shape), etc.) that is revolved around a central axis in the plane of the two-dimensional shape. For example, when a toroidal surface is formed by revolving a circle, a "donut" shape can be formed. The two-dimensional shape can be revolved around any axis, which can include the first center axis 364, the second center axis 374, or both. For example, the first toroidal surface 350 can share a center axis with at least one of the plunger bore 362 (e.g., as shown in FIG. 3) or the fluid conveying cross bore 372. In an example, the center axis of the first toroidal surface 350 may not be either the first center axis 364 or the second center axis 374 (e.g., as shown in FIGS. 10-16). For example, the center axis of the first toroidal surface 350 can be offset (e.g., laterally offset (e.g., as shown in FIGS. 10 and 11), offset at an angle) from one or more of the first center axis 364 or the second center axis 374, such as can include offset at an angle of one or more degrees, three or more degrees, five or more degrees, 10 or more degrees, or 20 or more degrees.

The first toroidal surface 350 can have a width 368. The width 368 can vary along a length of the first toroidal surface 350 (e.g., along a length of the first bore intersection rim 354). For example, FIG. 3 shows that the width 368 can reach a minimum at a point where the first bore intersection rim 354 intersects a plane defined by the first center axis 364 and the second center axis 374. The width 368 can reach a maximum at a point farthest from the plane defined by the first center axis 364 and the second center axis 374. In an example, the first toroidal surface 350 may only exist near the point where the first bore intersection rim 354 intersects the plane defined by the first center axis 364 and the second center axis 374 (e.g., as shown in FIGS. 12-16), such as can include within a specified number of degrees to either side of the intersection (e.g., 5 degrees each way, 10 degrees each way, 20 degrees each way). This can place the first toroidal surface 350 near the location that can have the highest stress. As shown in FIG. 3, there can be two or more locations where the first bore intersection rim 354 intersects the plane defined by the second center axis 374 and the first center axis 364.

The first toroidal surface 350 can define a portion of the surface of a toroid (e.g., the first toroidal surface 350 may not define an entire toroid). The width 368 can be defined by the portion of the toroid in the first toroidal surface 350 at a specified point.

The second center axis 374 and the first center axis 364 can be arranged at any angle and/or position with respect to each other. FIG. 3 shows an example where the second center axis 374 can be orthogonal to the first center axis 364. However, in an example, the second center axis 374 may not be orthogonal to the first center axis 364, but may define any angle with respect to the first center axis 364 (e.g., an 80 degree angle, a 60 degree angle, a 30 degree angle, etc.). FIG. 3 shows an example where the second center axis 374 and the first center axis 364 can intersect. However, in an example, the second center axis 374 and the 364 may not intersect (e.g., the second center axis 374 and the first center axis 364 can be offset from one another (e.g., as shown in FIG. 10 and FIG. 11), such as can include not being in the same plane).

In an example, the fluid end block 232 can include a Y-shaped fluid end block. In an example, the fluid conveying cross bore 372 can be divided into two portions, which may not share a center axis (e.g., the center axes can intersect, but may not be colinear). In this example, three distinct bores can intersect (e.g., fluidly communicate), such as can include the center axis of the three bores intersecting. The three bores can intersect in the pumping chamber 340. For example, the fluid end block 232 can include a plunger bore 362, a fluid inlet bore (e.g., the first portion of the fluid conveying cross bore 372), and a fluid outlet bore (e.g., the second portion of the fluid conveying cross bore 372). The plunger bore 362, the fluid inlet bore, and the fluid outlet bore can intersect at any combination or permutation of angles. In an example, two or more of the center axes of the plunger bore 362, the fluid inlet bore, and the fluid outlet bore can intersect. In an example, two or more of center axes of the plunger bore 362, the fluid inlet bore, and the fluid outlet bore may not intersect. In an example, two or more of the center axes of the of the plunger bore 362, the fluid inlet bore, and the fluid outlet bore can be coplanar.

The fluid conveying cross bore 372 can also intersect the plunger bore 362 along a second bore intersection rim 356. The second bore intersection rim 356 can be defined by a second set of points of intersection between the second cylindrical wall 370 and the first cylindrical wall 360. In an example, as shown in FIG. 3, the first bore intersection rim 354 may not intersect the second bore intersection rim 356. A portion of the second bore intersection rim 356 can define a second toroidal surface 352. The second toroidal surface 352 can be configured to reduce a material stress in one or more portions of the second bore intersection rim 356, such as by spreading a stress out over a larger area. The second toroidal surface 352 can be configured similarly to the first toroidal surface 350, or can differ in one or more ways.

As also discussed above, the fluid end block 232 can be configured to provide a pumping chamber 340. The pumping chamber 340 can be a cavity with a volume that is designed to fluidly seal a fluid to be pumped. The volume of the pumping chamber 340 can change due to a motion of the plunger. For example, the volume of the pumping chamber 340 can increase during an intake stroke, which can include the plunger retracting away from and/or out of the fluid end block 232, and can decrease during a pumping stroke, which can include the plunger pushing towards and/or into the fluid end block 232. In an example, a portion of the pumping chamber 340 is contained within the plunger assembly 220.

The fluid end block 232 can be configured to receive a first one-way valve, such as in the first valve body 322. The first one-way valve can be configured to allow fluid to flow into the fluid end block 232 (e.g., into the pumping chamber 340, such as from the inlet port 310) during the intake stroke and can prevent fluid from exiting the fluid end block 232 during the pumping stroke (e.g., prevent fluid from exiting out the inlet port 310). The fluid end block 232 can be configured to receive a second one-way valve, such as in the second valve body 324. The second one-way valve can be configured to allow fluid to exit the fluid end block 232 (e.g., exit the pumping chamber 340, such as through the outlet port 330) during the pumping stroke, and can prevent fluid from entering the fluid end block 232 during the intake stroke (e.g., prevent fluid from flowing in from the outlet port 330, which can include blocking a back pressure, such as from a pressurized well and/or another plunger in pumping stroke).

The fluid end block 232 can also include one or more threads for engaging with a packing element. For example, the first packing threads 380, the second packing threads 382, and the third packing threads 384. The packing threads can be configured to receive a packing element or other threaded element, such as can include a seal, a plug, the plunger assembly 220, etc. The packing threads can be configured to interface with one or more elements (e.g., the plunger assembly 220), or provide access to an inside portion of the fluid end block 232, such as for assembly or repair (e.g., installing and/or removing one-way valves). In an example, the first packing threads 380 can receive a packing element (e.g., a stuffing box), and the second packing threads 382 and the third packing threads 384 can receive retainer nuts, such as can retain seal plugs.

The fluid end block 232 can be manufactured of any material, which can include one or more of a metal (e.g., iron), an alloy (e.g., steel), a composite, etc. The fluid end block 232 can be manufactured in any way, which can include one or more of machined (e.g., milled, drilled, bored), or cast, etc.

In an example, there can be any number of toroidal surfaces extending along a bore intersection rim, such as can include one toroidal surface, two toroidal surfaces (e.g., as shown in FIG. 3 and FIGS. 12-16), three toroidal surfaces, or four or more toroidal surfaces.

Figure 4:
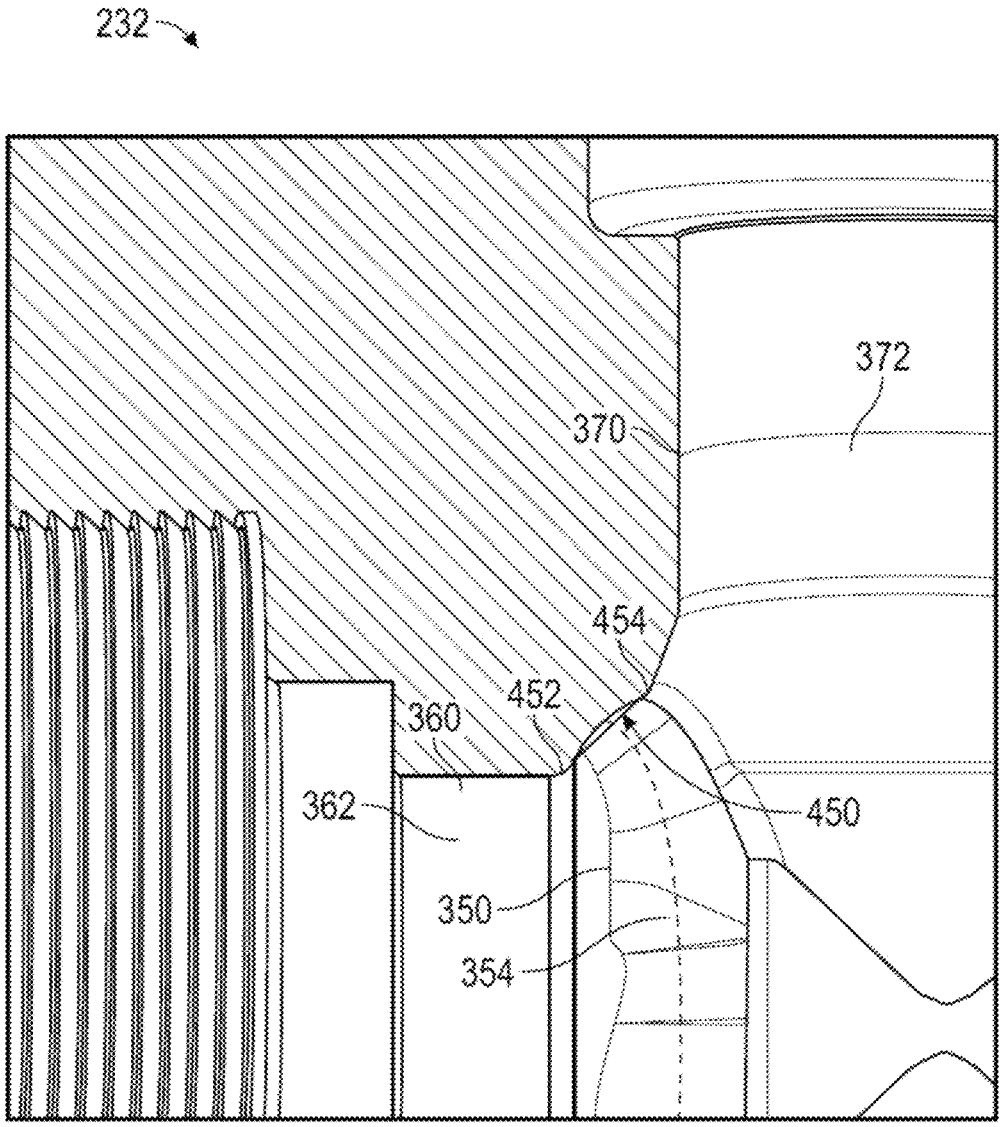
FIG. 4 shows a cross-sectional view of an example of portions of the fluid end block of FIG. 3.

FIG. 4 shows a cross-sectional view of an example of portions of the fluid end block 232 of FIG. 3. FIG. 4 shows that a portion of the first bore intersection rim 354 can define a concave surface 450. The first bore intersection rim 354 can define a concave surface 450 alternatively or in addition to defining a first toroidal surface 350.

The concave surface 450 can be configured to reduce a material stress in one or more portions of the first bore intersection rim 354, such as by spreading a stress out over a larger area. The concave surface 450 can include a shape that is concave away from one or more of the fluid conveying cross bore 372 or the plunger bore 362. The concave surface 450 can be any shape, such as can include a portion of a circle, a portion of an ellipsis, a smooth freeform shape (e.g., no corners), a freeform shape with corners, etc. In an example, the concave surface 450 can include a portion that is not concave (e.g., a bump in the middle of the concave surface 450 projecting into the fluid conveying cross bore 372 and/or the plunger bore 362). Similarly to the first toroidal surface 350, the concave surface 450 can extend across all of the first bore intersection rim 354 (e.g., around the entire plunger bore 362), or can be limited to one or more regions of the first bore intersection rim 354.

There can be a first radiused corner 452 on a first side of the concave surface 450, which can include an outside of the concave surface 450 nearest the first cylindrical wall 360. The first radiused corner 452 can be can be configured to reduce a material stress in one or more portions of the first bore intersection rim 354, such as by spreading a stress out over a larger area.

There can be a second radiused corner 454 on a second side of the concave surface 450, which can include an outside of the concave surface 450 nearest the fluid conveying cross bore 372. The second radiused corner 454 can be configured to reduce a material stress in one or more portions of the first bore intersection rim 354, such as by spreading a stress out over a larger area. In an example, the second bore intersection rim 356 can also include a concave surface. In an example, there can be any number of concave surfaces.

Figure 5:
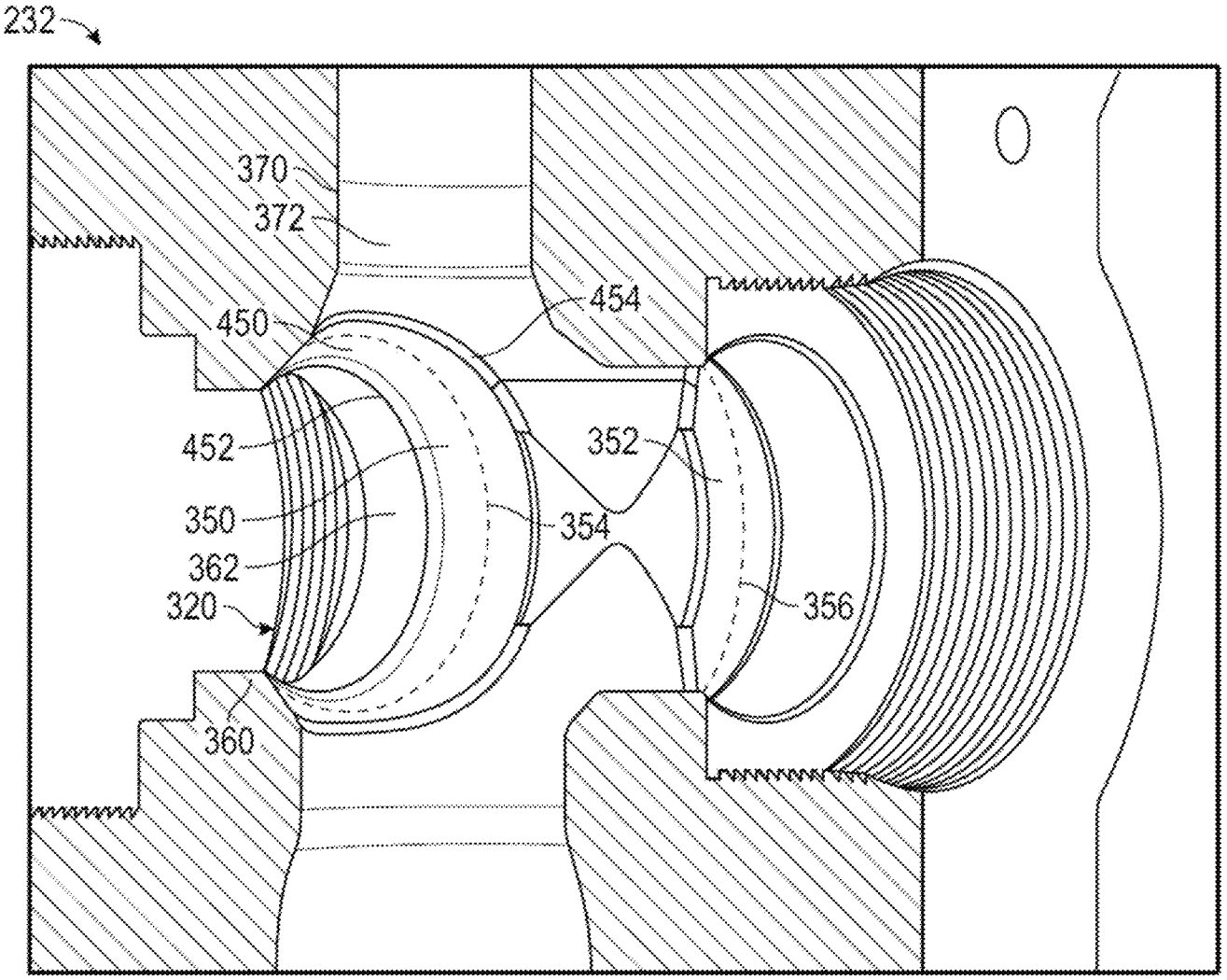
FIG. 5 shows a cross-sectional perspective view of an example of portions of the fluid end block of FIG. 3.

FIG. 5 shows a cross-sectional perspective view of an example of portions of the fluid end block 232 of FIG. 3. FIG. 5 shows the fluid end block 232 in a direction partially facing the plunger assembly interface port 320. FIG. 5 shows the first toroidal surface 350 and the concave surface 450 extending along the first bore intersection rim 354. FIG. 5 also shows the second toroidal surface 352 extending along the second bore intersection rim 356.

Figure 6:
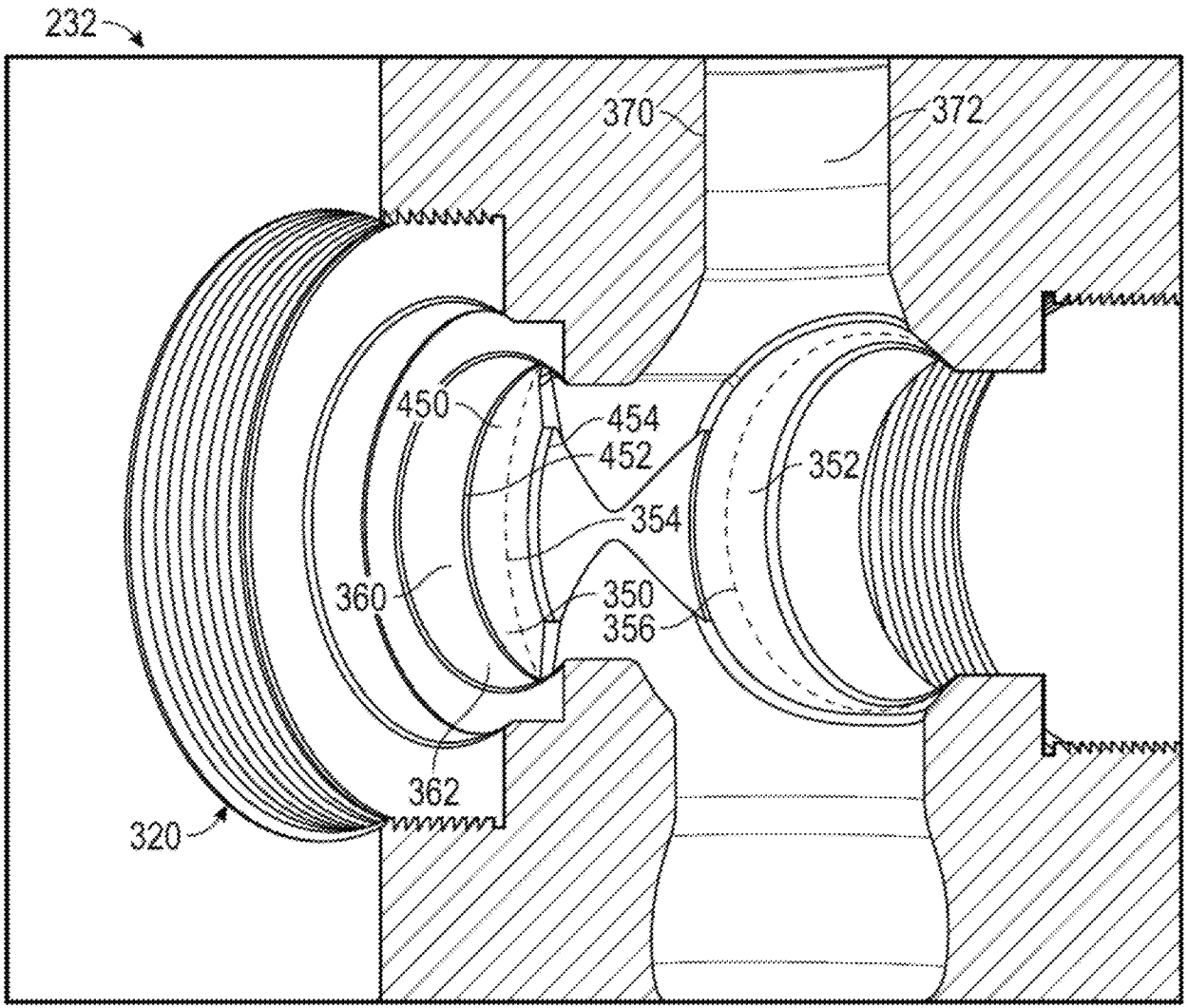
FIG. 6 shows a cross-sectional perspective view of an example of portions of the fluid end block of FIG. 3.

FIG. 6 shows a cross-sectional perspective view of an example of portions of the fluid end block 232 of FIG. 3. FIG. 6 shows the fluid end block 232 in a direction partially facing away from the plunger assembly interface port 320. FIG. 6 shows the first toroidal surface 350 and the concave surface 450 extending along the first bore intersection rim 354. FIG. 6 also shows the second toroidal surface 352 extending along the second bore intersection rim 356.

FIG. 10 shows a cross-sectional perspective view of an example of portions of a fluid end block 232 and a first toroid 1004. FIG. 10 shows that the center axis 1002 of the first toroid 1004 can be offset (e.g., laterally offset) from the first center axis 364 of the plunger bore 362, as discussed above with respect to FIG. 3. FIG. 11 shows a cross-sectional perspective view of an example of portions of the fluid end block 232 of FIG. 10 and a second toroid 1006, as discussed above with respect to FIG. 3. FIG. 11 shows that the center axis 1008 of the second toroid 1006 can be offset (e.g., laterally offset) from the first center axis 364 of the plunger bore 362.

Figure 12:
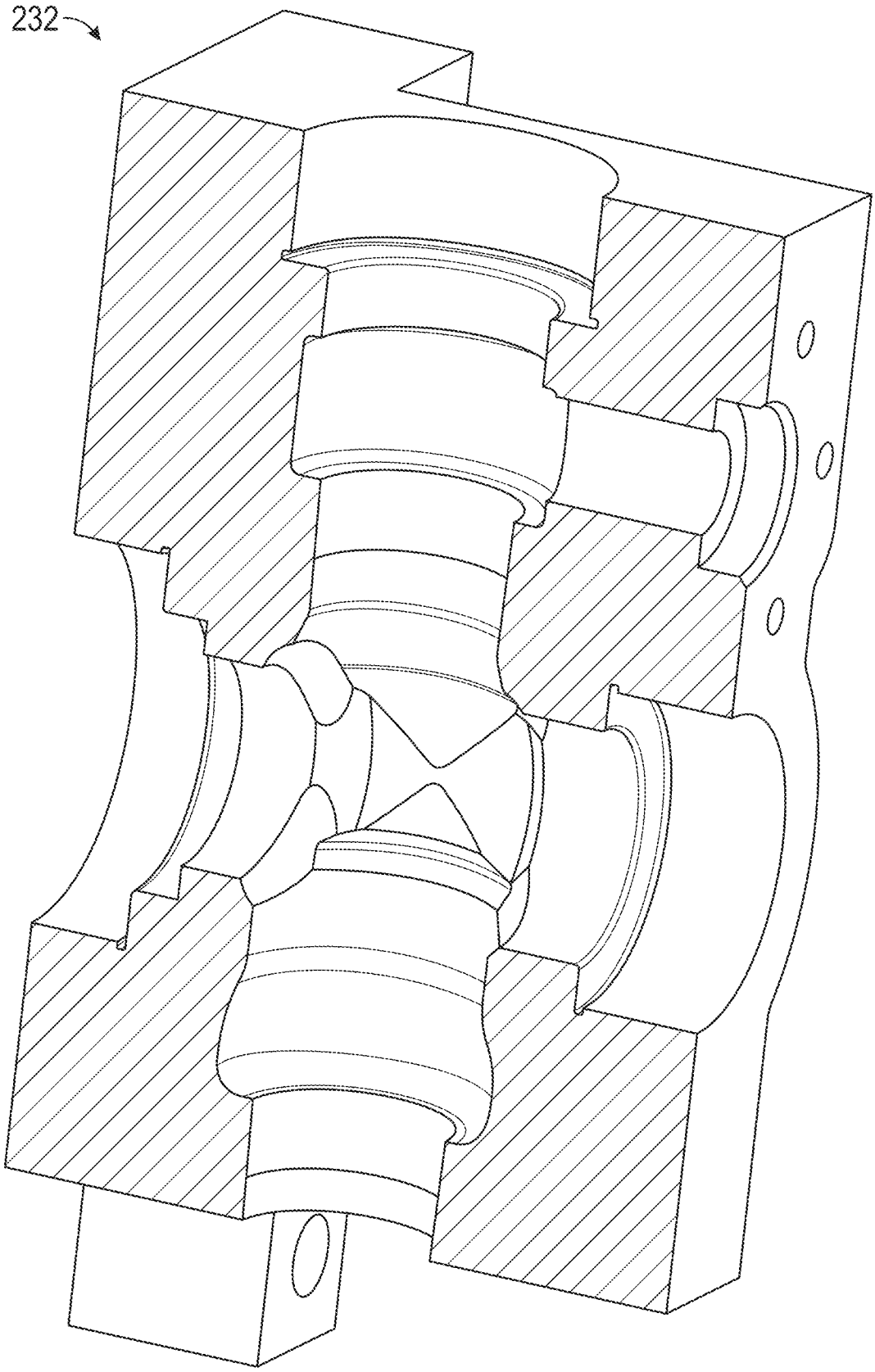
FIG. 12 shows a cross-sectional perspective view of an example of portions of a fluid end block with toroidal surfaces defined by the toroids of FIG. 10 and FIG. 11.
Figure 13:
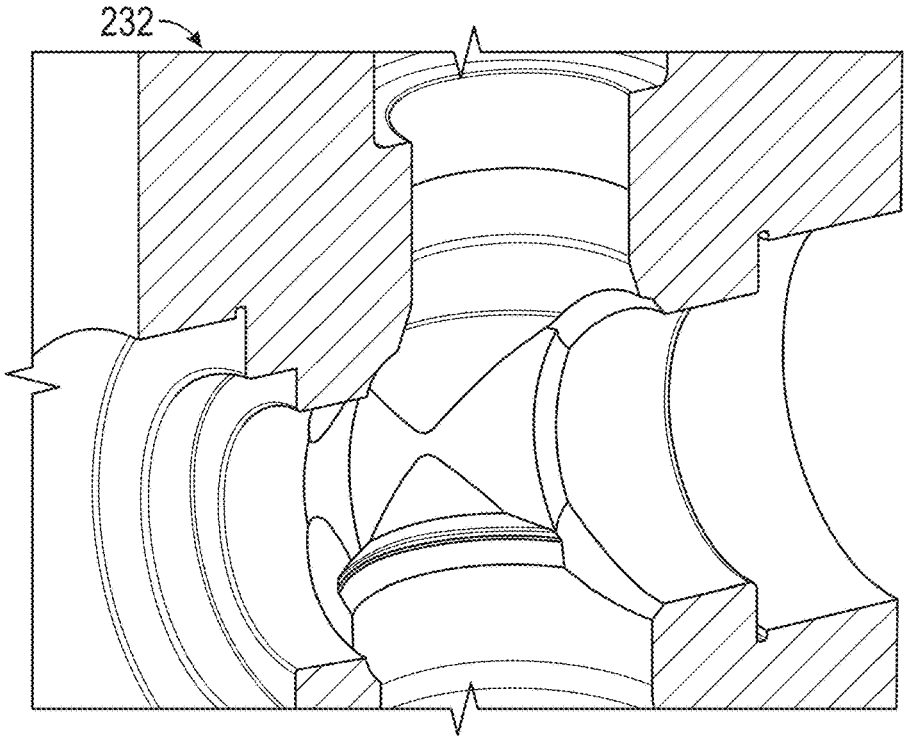
FIG. 13 shows a cross-sectional perspective view of an example of portions of the fluid end block of FIG. 12.
Figure 14:
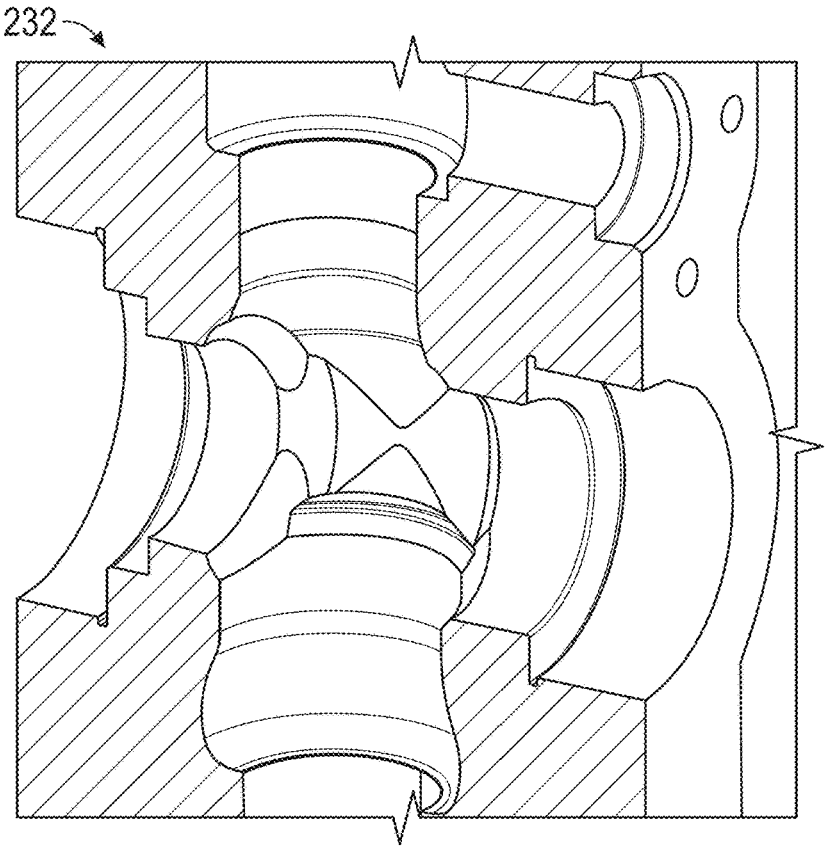
FIG. 14 shows a cross-sectional perspective view of an example of portions of the fluid end block of FIG. 12.
Figure 15:
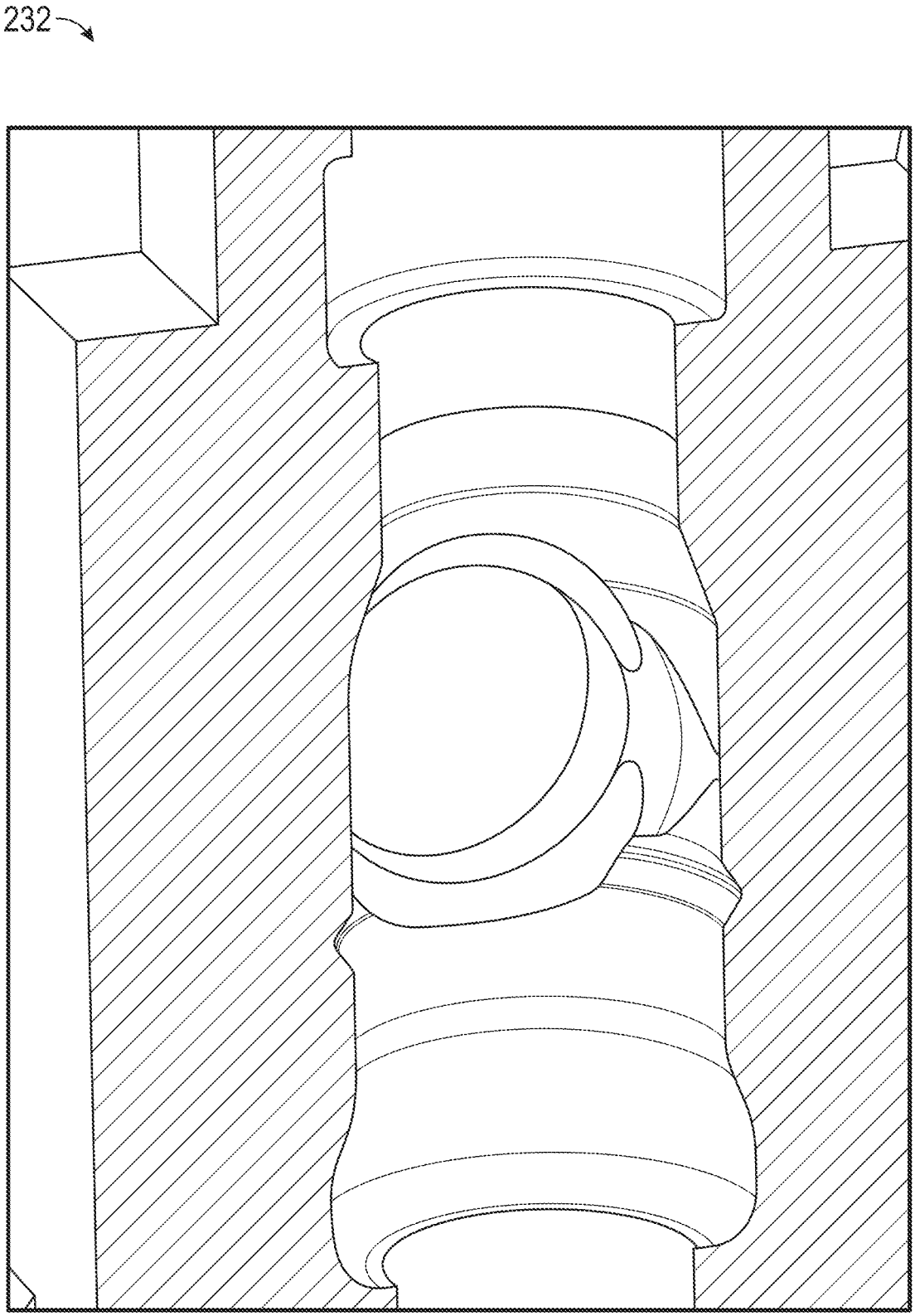
FIG. 15 shows a cross-sectional perspective view of an example of portions of the fluid end block of FIG. 12.
Figure 16:
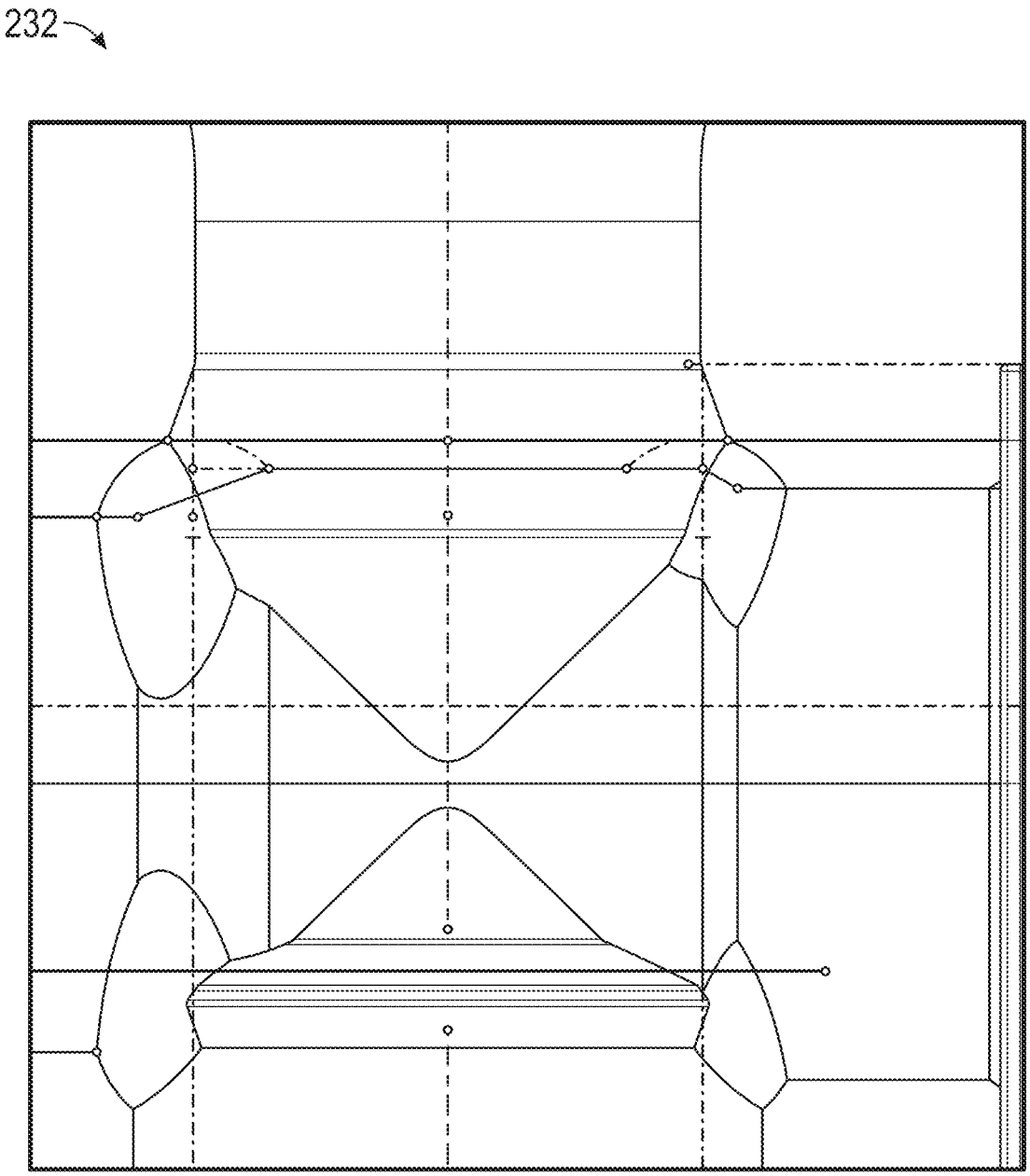
FIG. 16 shows a two-dimensional projection of an example of portions of the fluid end block of FIG. 12.

FIG. 12 shows a cross-sectional perspective view of an example of portions of a fluid end block 232 with toroidal surfaces defined by the toroid 1004 of FIG. 10 and toroid 1006 of FIG. 11. FIG. 12 also shows that the first bore intersection rim 354 and/or the second bore intersection rim 356 can include a second toroidal surface, such as can be defined by toroids other than the first toroid 1004 or the second toroid 1006. For example, the first bore intersection rim 354 and/or the second bore intersection rim 356 can include a second toroidal surface that is on a lower side of the intersection rim, substantially laterally opposite the first toroidal surface.

Figure 7:
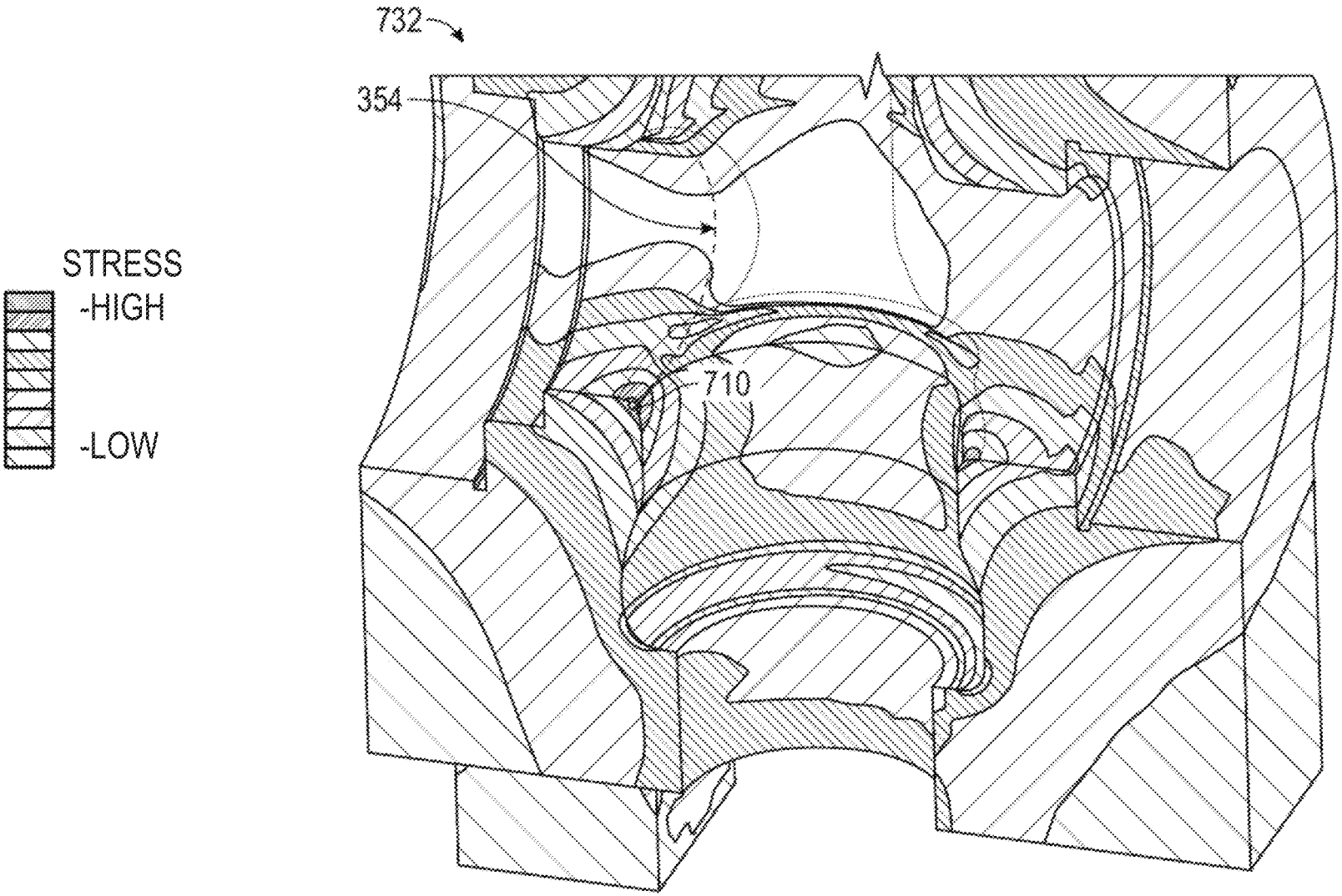
FIG. 7 shows a perspective view of a stress plot of an example of portions of a fluid end block without a toroidal surface.

FIG. 7 and FIG. 8 show simulated stress plots of examples of fluid end blocks of similar dimensions and configuration, subjected to similar stress (e.g., the same pressure), except that the fluid end block 732 of FIG. 7 does not include a toroidal surface like the fluid end block 232 of FIG. 8. FIG. 7 shows a perspective view of a stress plot of an example of portions of a fluid end block 732 without a toroidal surface. For example, the first bore intersection rim 354 of the fluid end block 732 is a radiused corner without a toroidal surface and/or a concave surface. FIG. 7 shows that the maximum stress (e.g., the maximum principal stress) in the fluid end block 732 is at point 710, which occurs at and/or near an intersection of the first bore intersection rim 354 with a plane defined by the second center axis 374 and the first center axis 364.

FIG. 8 shows a perspective view of a stress plot of an example of portions of the fluid end block 232 of FIG. 3, including the first toroidal surface 350. FIG. 8 shows that the maximum stress in the fluid end block 232 is at point 810 and/or at point 812. Point 810 and point 812 are at and/or near an intersection of the first bore intersection rim 354 with a plane defined by the second center axis 374 and the first center axis 364. The maximum stress of FIG. 8 represents an approximately 25 percent or greater decrease in maximum stress as compared to the example of FIG. 7.

Figure 9:
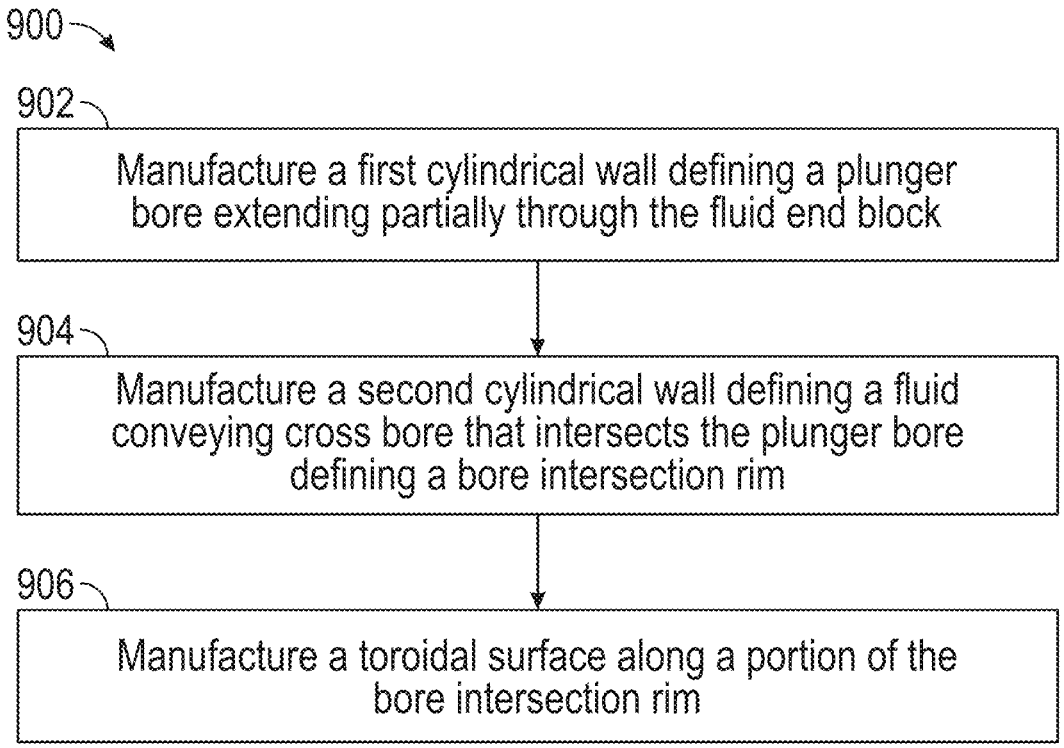
FIG. 9 shows a diagram depicting an example of portions of a method of manufacturing a fluid end block.

FIG. 9 shows a diagram depicting an example of portions of a method 900 of manufacturing a fluid end block (e.g., the fluid end block 232), such as can included in a positive displacement pump system (e.g., the positive displacement pump system 110). At step 902, a first cylindrical wall can be manufactured defining a plunger bore extending partially through the fluid end block. The first cylindrical wall can be manufactured through boring a piece of material to one or more of create, expand, or surface the plunger bore.

At step 904, a second cylindrical wall can be manufactured defining a fluid conveying cross bore that intersects the plunger bore defining a bore intersection rim. The second cylindrical wall can be manufactured through boring a piece of material to one or more of create, expand, or surface the fluid conveying cross bore.

At step 906, a toroidal surface can be manufactured along a portion of the bore intersection rim. Manufacturing the toroidal surface can include machining the toroidal surface along at least a portion of the bore intersection rim. This can include removing material that remains following machining the plunger bore and the fluid conveying cross bore.

The fluid end block can be manufactured using one or more of casting, machining, pouring, etching, welding, bolting, etc. In an example, manufacturing the fluid end block can include forming a mold configured to produce a fluid end block with one or more of a plunger bore, fluid conveying cross bore, or toroidal surface, and casting the fluid end block by pouring liquid material into the mold and letting the material solidify. Following the casting, one or more portions of the fluid end block can be machined (e.g., bored, surfaced, etc.), such as can include boring the plunger bore, boring the fluid conveying cross bore, or machining the toroidal surface.

The shown order of steps is not intended to be a limitation on the order the steps are performed in. In an example, two or more steps may be performed simultaneously or at least partially concurrently.

The following, non-limiting examples, detail certain aspects of the present subject matter to solve the challenges and provide the benefits discussed herein, among others.

EXAMPLES

Example 1 is a positive displacement pump system comprising: a fluid end block configured to provide a pumping chamber and control a flow of a fluid through the positive displacement pump system, the fluid end block comprising: a first cylindrical wall defining a plunger bore extending partially through the fluid end block; a second cylindrical wall defining a fluid conveying cross bore that intersects the plunger bore defining a bore intersection rim; and wherein a portion of the first bore intersection rim comprises a first toroidal surface.

In Example 2, the subject matter of Example 1 optionally includes wherein the first toroidal surface is elliptical in cross section.

In Example 3, the subject matter of any one or more of Examples 1-2 optionally include wherein the first toroidal surface is present along a full length of the first bore intersection rim.

In Example 4, the subject matter of any one or more of Examples 1-3 optionally include wherein the first toroidal surface shares a center axis with at least one of the plunger bore or the fluid conveying cross bore.

In Example 5, the subject matter of any one or more of Examples 1-4 optionally include wherein a first center axis of the plunger bore is orthogonal to a second center axis of the fluid conveying cross bore.

In Example 6, the subject matter of Example 5 optionally includes wherein the first center axis and the second center axis intersect.

In Example 7, the subject matter of Example 6 optionally includes wherein a width of the first toroidal surface varies along the first bore intersection rim.

In Example 8, the subject matter of Example 7 optionally includes wherein a width of the first toroidal surface reaches a minimum at a point where the bore intersection rim intersects a plane defined by the first center axis and the second center axis.

In Example 9, the subject matter of any one or more of Examples 6-8 optionally include wherein a first diameter of the plunger bore is different from a second diameter of the fluid conveying cross bore.

In Example 10, the subject matter of Example 9 optionally includes wherein: the plunger bore and the fluid conveying cross bore intersect along a second bore intersection rim; and at least a portion of the second bore intersection rim defines a second toroidal surface.

In Example 11, the subject matter of any one or more of Examples 1-10 optionally include wherein the positive displacement pump system includes three plunger bores.

In Example 12, the subject matter of Example 11 optionally includes distinct fluid end blocks for each of the three plunger bores.

In Example 13, the subject matter of any one or more of Examples 1-12 optionally include wherein: the plunger bore is configured to receive at least one of a plunger or piston; and the fluid conveying cross bore is configured to transport fluid into the fluid end block during an intake stroke and expel fluid from the fluid end block during a pumping stroke.

In Example 14, the subject matter of Example 13 optionally includes wherein the fluid conveying cross bore is configured to: receive a first one-way valve to allow fluid into the fluid end block during the intake stroke; and receive a second one-way valve to allow fluid to exit the fluid end block during the pumping stroke.

Example 15 is a positive displacement pump system comprising: a fluid end block, configured to provide a pumping chamber and control a flow of a fluid through the positive displacement pump system, the fluid end block comprising: a first cylindrical wall defining a plunger bore extending partially through the fluid end block; a second cylindrical wall defining a fluid conveying cross bore that intersects the plunger bore defining a bore intersection rim; and wherein a portion of the bore intersection rim defines a concave surface.

In Example 16, the subject matter of Example 15 optionally includes wherein the concave surface includes a first radiused corner on an outside of the concave surface nearest the plunger bore, and a second radiused corner on the outside of the concave surface nearest the fluid conveying cross bore.

Example 17 is a method of manufacturing a fluid end block of a positive displacement pump system, the method comprising: manufacturing a first cylindrical wall defining a plunger bore extending partially through the fluid end block; manufacturing a second cylindrical wall defining a fluid conveying cross bore that intersects the plunger bore defining a bore intersection rim; and manufacturing a toroidal surface along a portion of the bore intersection rim.

In Example 18, the subject matter of Example 17 optionally includes wherein manufacturing the toroidal surface along a portion of the bore intersection rim includes machining the toroidal surface.

In Example 19, the subject matter of Example 18 optionally includes wherein manufacturing the toroidal surface along at least a portion of the bore intersection rim includes: boring the plunger bore and the fluid conveying cross bore; and machining the toroidal surface along at least a portion of the bore intersection rim.

In Example 20, the subject matter of any one or more of Examples 17-19 optionally include wherein manufacturing the toroidal surface along at least a portion of the bore intersection rim includes: forming a mold configured to produce a fluid end block with the plunger bore, the fluid conveying cross bore, and the toroidal surface; and casting the fluid end block.

Example 21 is at least one machine-readable medium including instructions that, when executed by processing circuitry, cause the processing circuitry to perform operations to implement of any of Examples 1-20.

Example 22 is an apparatus comprising means to implement of any of Examples 1-20.

Example 23 is a system to implement of any of Examples 1-20.

Example 24 is a method to implement of any of Examples 1-20.

Each of the non-limiting aspects above can stand on its own or can be combined in various permutations or combinations with one or more of the other aspects or other subject matter described in this document.

The above detailed description includes references to the accompanying drawings, which form a part of the detailed description. The drawings show, by way of illustration, specific examples that may be practiced. These embodiments are also referred to herein as "examples." Such examples may include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the terms "or" and "and/or" are used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The term "about," as used herein, means approximately, in the region of, roughly, or around. When the term "about" is used in conjunction with a numerical range, it modifies that range by extending the boundaries above and below the numerical values set forth. In general, the term "about" is used herein to modify a numerical value above and below the stated value by a variance of 10%. In one aspect, the term "about" means plus or minus 10% of the numerical value of the number with which it is being used. Therefore, about 50% means in the range of 45%-55%. Numerical ranges recited herein by endpoints include all numbers and fractions subsumed within that range (e.g., 1 to 5 includes 1, 1.5, 2, 2.75, 3, 3.90, 4, 4.24, and 5). Similarly, numerical ranges recited herein by endpoints include subranges subsumed within that range (e.g., 1 to 5 includes 1-1.5, 1.5-2, 2-2.75, 2.75-3, 3-3.90, 3.90-4, 4-4.24, 4.24-5, 2-5, 3-5, 1-4, and 2-4).

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Such instructions can be read and executed by one or more processors to enable performance of operations comprising a method, for example. The instructions are in any suitable form, such as but not limited to source code, compiled code, interpreted code, executable code, static code, dynamic code, and the like.

Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other examples may be used, such as by one of ordinary skill in the art upon reviewing the above description. The Abstract is to allow the reader to quickly ascertain the nature of the technical disclosure and is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the examples should be determined with reference to the appended claims, along with the full scope of equivalents to which such claims are entitled.

What is claimed is:

1. A positive displacement pump system comprising:

a fluid end block configured to provide a pumping chamber and control a flow of a fluid through the positive displacement pump system, the fluid end block comprising:

a first cylindrical wall defining a plunger bore extending partially through the fluid end block;

a second cylindrical wall defining a fluid conveying cross bore that intersects the plunger bore defining a first bore intersection rim; and wherein a portion of the first bore intersection rim comprises a first toroidal surface, wherein a center axis of a first toroid defining the first toroidal surface is not coincident with a center axis of the plunger bore and not coincident with a center axis of the fluid conveying cross bore.

2. The positive displacement pump system of claim 1, wherein the first toroidal surface is elliptical in cross section.

3. The positive displacement pump system of claim 1, wherein the first toroidal surface is present along a full length of the first bore intersection rim.

4. The positive displacement pump system of claim 1, wherein the center axis of the plunger bore is orthogonal to the center axis of the fluid conveying cross bore.

5. The positive displacement pump system of claim 4, wherein the center axis of the plunger bore and the center axis of the fluid conveying cross bore intersect.

6. The positive displacement pump system of claim 5, wherein a width of the first toroidal surface varies along the first bore intersection rim.

7. The positive displacement pump system of claim 6, wherein a width of the first toroidal surface reaches a minimum at a point where the first bore intersection rim intersects a plane defined by the center axis of the plunger bore and the center axis of the fluid conveying cross bore.

8. The positive displacement pump system of claim 5, wherein a first diameter of the plunger bore is different from a second diameter of the fluid conveying cross bore.

9. The positive displacement pump system of claim 8, wherein:

the plunger bore and the fluid conveying cross bore intersect along a second bore intersection rim; and at least a portion of the second bore intersection rim defines a second toroidal surface.

10. The positive displacement pump system of claim 1, wherein the positive displacement pump system includes three plunger bores.

11. The positive displacement pump system of claim 10, comprising distinct fluid end blocks for each of the three plunger bores.

12. The positive displacement pump system of claim 1, wherein:

the plunger bore is configured to receive at least one of a plunger or piston; and the fluid conveying cross bore is configured to transport fluid into the fluid end block during an intake stroke and expel fluid from the fluid end block during a pumping stroke.

13. The positive displacement pump system of claim 12, wherein the fluid conveying cross bore is configured to:

receive a first one-way valve to allow fluid into the fluid end block during the intake stroke; and receive a second one-way valve to allow fluid to exit the fluid end block during the pumping stroke.

14. The positive displacement pump system of claim 1, wherein the center axis of the first toroid is substantially parallel to and offset laterally from at least one of the center axis of the plunger bore or the center axis of the fluid conveying cross bore.

15. The positive displacement pump system of claim 14, wherein the first bore intersection rim comprises a second toroidal surface.

16. The positive displacement pump system of claim 15, wherein:

a center axis of a second toroid defining the second toroidal surface is not coincident with the center axis of the plunger bore and not coincident with the center axis of the fluid conveying cross bore; and the center axis of the second toroid is substantially parallel to and offset laterally from the at least one of the center axis of the plunger bore or the center axis of the fluid conveying cross bore in a direction substantially opposite from the center axis of the first toroid.

17. The positive displacement pump system of claim 1, wherein the center axis of the first toroid is offset at an angle from at least one of the center axis of the plunger bore or the center axis of the fluid conveying cross bore.

18. A positive displacement pump system comprising:

a fluid end block, configured to provide a pumping chamber and control a flow of a fluid through the positive displacement pump system, the fluid end block comprising:

a first cylindrical wall defining a plunger bore extending partially through the fluid end block;

a second cylindrical wall defining a fluid conveying cross bore that intersects the plunger bore defining a bore intersection rim; and wherein a portion of the bore intersection rim defines a first toroidal surface, wherein a center axis of a first toroid defining the first toroidal surface is not coincident with a center axis of the plunger bore and not coincident with a center axis of the fluid conveying cross bore.

19. The positive displacement pump system of claim 18, wherein the first toroidal surface includes a first radiused corner on an outside of the first toroidal surface nearest the plunger bore, and a second radiused corner on the outside of the first toroidal surface nearest the fluid conveying cross bore.

20. A method of manufacturing a fluid end block of a positive displacement pump system, the method comprising:

manufacturing a first cylindrical wall defining a plunger bore extending partially through the fluid end block;

manufacturing a second cylindrical wall defining a fluid conveying cross bore that intersects the plunger bore defining a bore intersection rim; and manufacturing a toroidal surface along a portion of the bore intersection rim, wherein a center axis of a toroid defining the toroidal surface is not coincident with a center axis of the plunger bore and not coincident with a center axis of the fluid conveying cross bore.

21. The method of claim 20, wherein manufacturing the toroidal surface along a portion of the bore intersection rim includes machining the toroidal surface.

22. The method of claim 21, wherein manufacturing the toroidal surface along at least a portion of the bore intersection rim includes:

boring the plunger bore and the fluid conveying cross bore; and machining the toroidal surface along at least a portion of the bore intersection rim.

23. The method of claim 20, wherein manufacturing the toroidal surface along at least a portion of the bore intersection rim includes:

forming a mold configured to produce a fluid end block with the plunger bore, the fluid conveying cross bore, and the toroidal surface; and casting the fluid end block.

* * * * *